US006158680A

United States Patent [19]

Ranne

[11] Patent Number: 6,158,680

[45] Date of Patent: Dec. 12, 2000

[54] MULTI-BARREL MEDIA MILL AND METHOD OF GRINDING

[76] Inventor: Bill H. Ranne, 317 E. Orleans, Jackson, Tenn. 38301

[21] Appl. No.: 09/162,585

[22] Filed: Sep. 29, 1998

[51] Int. Cl.[7] ..... B02C 17/16

[52] U.S. Cl. ..... 241/65; 241/171; 241/172; 241/179

[58] Field of Search ..... 241/171, 172, 241/46.11, 46.17, 65, 179, 187, 285.1, 154, 188.1; 366/15, 85, 291, 298, 300

[56] References Cited

U.S. PATENT DOCUMENTS

| | | | |
|---|---|---|---|
| 2,466,828 | 4/1949 | Samson | 241/154 |
| 3,008,657 | 11/1961 | Szegvari | 241/172 |
| 3,539,117 | 11/1970 | Sjogren . | |
| 3,696,817 | 10/1972 | Bonner et al. | 241/154 |
| 4,174,074 | 11/1979 | Geiger | 241/172 |
| 4,496,106 | 1/1985 | Gross . | |
| 4,673,134 | 6/1987 | Barthelmess | 241/172 |
| 4,998,678 | 3/1991 | Durr . | |
| 5,114,083 | 5/1992 | Ikebuchi et al. | 241/172 |

FOREIGN PATENT DOCUMENTS

| | | | |
|---|---|---|---|
| 1133614 | 7/1962 | Germany | 241/172 |
| 4307083 | 9/1994 | Germany | 241/172 |
| 710634 | 1/1980 | U.S.S.R. | 241/172 |

OTHER PUBLICATIONS

Form No. 397–5M, 1997, Union Process, HQ Series High Speed Circulation Attritor, Small Media Milling System.

BM02A.DOC, Supplementary Data Sheet, Pilot & Production Sized 'Maxi'Motormills , Eiger Machinery Inc.

Draiswrke, Inc. "Innovative Concepts With Proven Design" Innovative Technology For All Your Processing Needs.

Schold Machine Corporation, New From Schold® Horizontal Media Mills.

FC 67405 en 9703 2000 DF Buhlere, High–Capacity Bead Mill, 9000 SC Topas, FKX.

2.5M Jul. 1985 COM/TECH (3597) Schold Machine Corp., Model HSSM High Speed Shot Mill.

9708–LT–7.5M EMCO U.S.A. (Epworth Morehouse–Cowles, Over 75 Years experience in mixing, dissolving and dispersing Guarantees Performance.

5/96/D15000 Draiswerke, Inc., The "original" Drais High–Performance Media Mills.

FC 67406 en 9611 2000 DF Buhler, K60 Conical Bead Mill.

DD 48002 B.EN 6 Superflow/3000/11.96/Th/Printed in Germany, Drais Mannheim DCP–Superflow®.

©1997 Netzsch Incorporated, Netzsch Galaxy, Module 250–10.

©1997, Union Process Inc., Union Process "DELTA-MILLl® Small Media Milling System".

Eiger Production, Quality Bead Mills For quality Products, Particle Size Reduction and Dispersion of Liquids and Pastes Products.

PM–S2 Oct. 1997 Supermill 2, Premier Mill, *Milling technology at its smartest and most productive.*

PM–S Aug. 1997 Supermill, Premier Mill, *Horizontal Media Mills designed for performance and versatility.*

Eiger 'Maxi' Mill, Self–Contained Laboratory Horizontal Bead Mill, 0.5, 1 and 2 Liter models.

*Primary Examiner*—Mark Rosenbaum
*Attorney, Agent, or Firm*—Luedeka, Neely & Graham PC

[57] ABSTRACT

A multiple barrel chamber for a media mill where the media mill is used to grind and disperse pigments for paint, coating, ink products, and other pigment-vehicle fluids, as well as grinding and dispersing other particulate matter. More particularly, a three barrel grinding chamber including a lengthwise rotatable shaft in each barrel portion is disclosed. Each shaft includes a disc array overlapping an adjacent disc array. Utilization of variable speed bi-directional motors, preferable independently controlled, to rotate each shaft allows impact, tack-shear, and slurry grinding to be accomplished with one media mill. The grinding efficiencies achieved far exceed those of conventional media mills. Media mill grinding discs are also disclosed.

30 Claims, 11 Drawing Sheets

MULTI-BARREL MEDIA MILL AND METHOD OF GRINDING

BACKGROUND OF THE INVENTION

The present invention relates generally to media mills.

More particularly, this invention pertains to a multiple barrel grinding chamber.

For more than a century (1825 to 1950) "Ball Mills" were used to grind and disperse pigment for paint, coatings, ink, and other pigment-vehicle fluids. Ball mills use steel, stone, or ceramic balls. Some disadvantages to ball mills are that they require a long dispersion time, they are hard to clean, and they take up large amounts of space. Not only are ball mills generally much larger than subsequent generation of grinding mills, but ball mills are generally supported in a horizontal configuration because the vertical configuration requires more floor space below the structure than the horizontal configuration. A more "modern" concern is an environmental one; ball mills create heavy noise pollution problems. This is primarily due to the "balls" banging about the mill, and the required heavy rotating machinery.

In the later 1950's, the first "Media Mills" were developed. Media mills, also known as "sand mills" or "sand grinders", use very small diameter grinding media, on the order of 20–40 mesh Ottawa type sand. This takes advantage of the large surface area per unit weight which cannot be used effectively in ball mills. The basic media mill structure consists of a vertical cylinder with a rotating shaft through its center, two or more flat impellers on a shaft, and a pump at the bottom which forces a premixed pigment-vehicle fluid paste through the milling zone and out through a discharge screen to retain the sand. Fluid is discharged into drums or pumped on for additional processing.

It is believed that in a single cylinder mill, grinding is mostly accomplished through impact of the mixture on the cylinder walls and shearing forces produced by velocity differences between layers of fluid. Dispersion is mostly the result of stacked vertices within the cylinder and the shearing forces. Rotating the impellers causes sand-paste mixture near their surfaces to rotate faster than the layers farther away. The layers closest to the top-side of an impeller are pulled from the shaft region and pushed toward the cylinder wall by the centrifugal force produced when the shaft is rotated. These layers are then forced up the side of the cylinder wall. Simultaneously, layers closest to the bottom-side of an impeller are also pulled from the shaft region and pushed towards the cylinder walls. In contrast to the layers closest to the top-side of an impeller, the layers closest to the bottom-side of an impeller will be forced down the walls of the cylinder. Thus, in an area between the top-side of an impeller and the bottom-side of an adjacent impeller, the fluid layers collide and are forced back toward the shaft region. This results in counter-clockwise rolled layers, i.e. a counter-clockwise vortex near the top-side of an impeller and a clockwise vortex near the bottom-side of an impeller.

The consistency of the sand-paste must be carefully adjusted. The fluid-paste must be viscous enough to be moved by impellers, but excessive viscosity reduces sand movement and milling action. Too low a consistency results in poor circulation, sand skidding, and wear on impellers. The machine may be cleaned by running solvent through it. However, sand costs are relatively cheap, so the sand may be discarded to avoid cleaning a hard to clean color out of media. Using sufficient premixers to ensure continuous flow of paste to the mill, the sand grinder can be used for automatic continuous operation.

While the standard single cylinder has been a significant improvement over standard ball mills and has been adequate for most purposes, it does have its drawbacks. Milling time can be long, especially for larger diameter particulates. Some matter, for instance carbon blacks, can only be milled using steel ball mills. Steel ball mills are not an acceptable milling process in today's environment due to the disadvantages previously mentioned. Additionally, standard gear pumps used in sand mills are subject to severe wear if media gets into the pumping gear and pump system.

It would be useful to develop an improved dispersing chamber with improved grinding efficiency over that of standard media mills. A chamber that would reduce the cycle time of hard to disperse/grind pigment, or grind particulates not heretofore possible to grind with a media mill, would be a significant improvement over existing dispersing chambers.

SUMMARY OF THE INVENTION

The present invention relates to media mills. More particularly it relates to media mills for grinding and dispersing particulate matter and fluid pigment vehicles. It provides a media mill capable of impact grinding, tack-shear grinding, and slurry grinding. One embodiment of the present invention includes a multiple barrel grinding chamber. One particular embodiment includes a three barrel grinding chamber wherein a rotatable shaft is mounted lengthwise within each barrel portion. A disc array is affixed to each rotatable shaft.

Rotation of the shafts causes particulate matter to impact and mix along boundary interfaces between the barrel portions. By varying the rotational speeds and directions of the shafts one can utilize this single media mill to accomplish impact grinding, or tack-shear grinding, or slurry grinding. Further, precise quality control can be achieved through infinite speed control of the rotatable shafts.

Other embodiments of the present invention include a unique discharge screen design, impeller design, bearing seal design, and cooling jacket design.

The present invention also teaches a variety of methods for propelling particulate matter to accomplish impact, tack-shear, or slurry grinding.

Accordingly, an object of the present invention is to provide a more efficient media mill.

Another object of the present invention is to obtain higher efficiency by utilizing a multiple barrel media mill.

Another object of the invention is to obtain a higher efficiency via a multiple shaft arrangement wherein particulate matter is propelled and intermixed by rotating the shafts.

Another object of the invention is to provide a single media mill capable of performing tack-shear grinding, impact grinding, and slurry grinding.

Another object of the invention is to provide a media mill which generates fewer vertices internal to the grinding chamber.

Another object of the present invention is to provide a means to achieve precise control over the product being ground.

Another object of the invention is to provide method and apparatus for achieving deeper color from fluorescents and other pigment vehicles having a crystaline structure.

Another embodiment of the invention is to provide a media mill capable of grinding tack mixtures without requiring an overpowered motor to achieve startup.

Another object of the present invention is to provide startup power when grinding tack mixtures by counter-rotating a shaft.

Another objective of the present invention is to provide a media mill less susceptible to barrel wear.

Another objective of the present invention is to provide a more environmentally friendly method of grinding.

A further objective of this invention is to accomplish more environmentally friendly grinding by utilizing a media mill which generates significantly less waste solvent than a conventional media mill.

A further object of the invention is to accomplish this environmentally friendly grinding by utilizing a media mill which generates significantly less noise pollution than a conventional media mill.

Another object of the invention is to provide a media mill which is more economical to operate than a conventional media mill.

Other objectives and advantages of the present invention will be apparent to those with skill in the art from following descriptions and accompanying drawings wherein preferred embodiments are shown.

DESCRIPTION OF THE PREFERRED EMBODIMENTS

Figure 1:
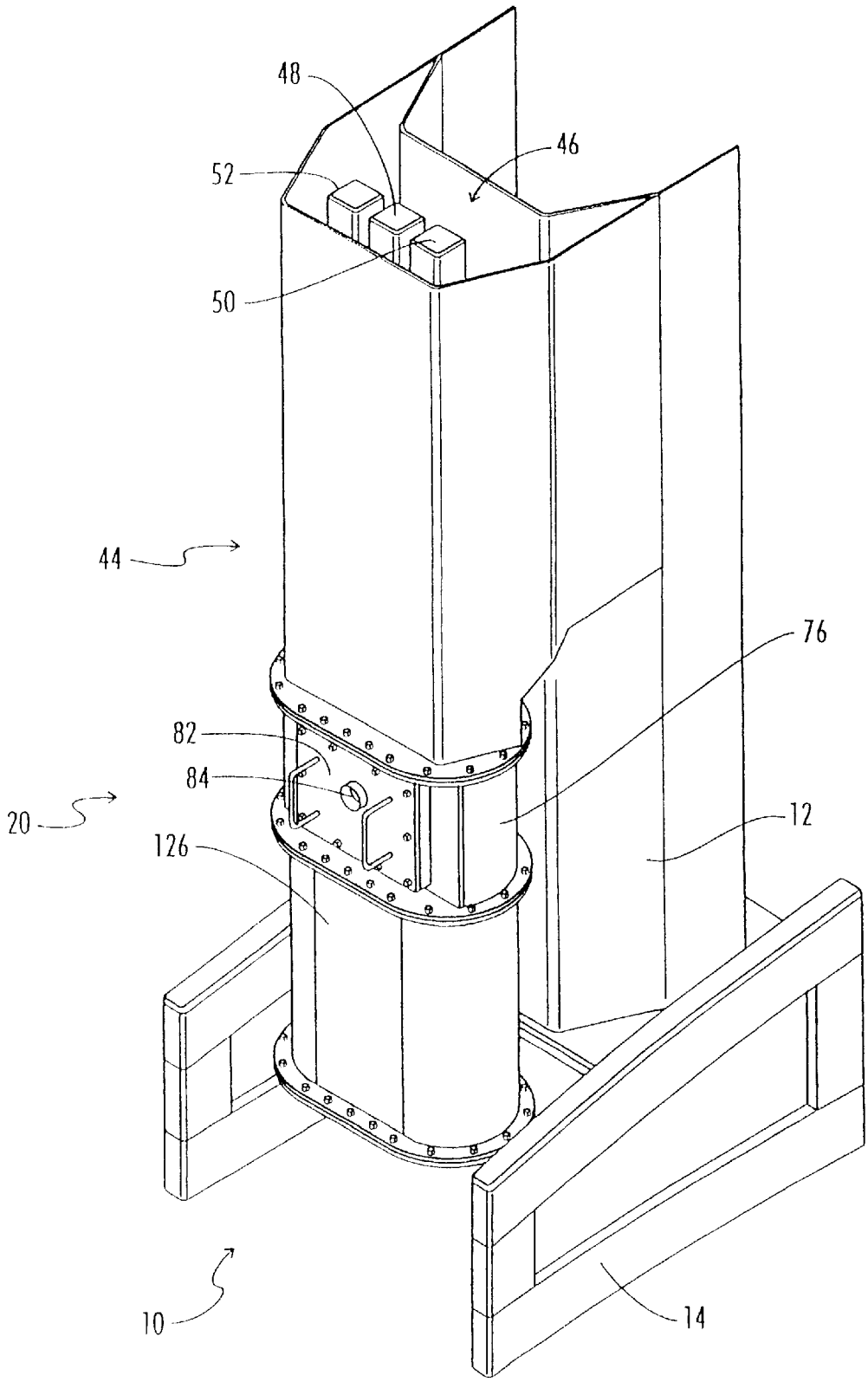
FIG. 1 shows a perspective view of a media mill of the present invention.

The present invention relates to media mills. More particularly it relates to media mills for grinding and dispersing particulate matter and pigment for paint coatings, ink, and other fluid pigment vehicles. This includes tack-shear grinding, slurry grinding, and impact grinding. The present invention will best be understood by reference to the attached drawings wherein like reference numerals and characters refer to like parts.

Figure 2:
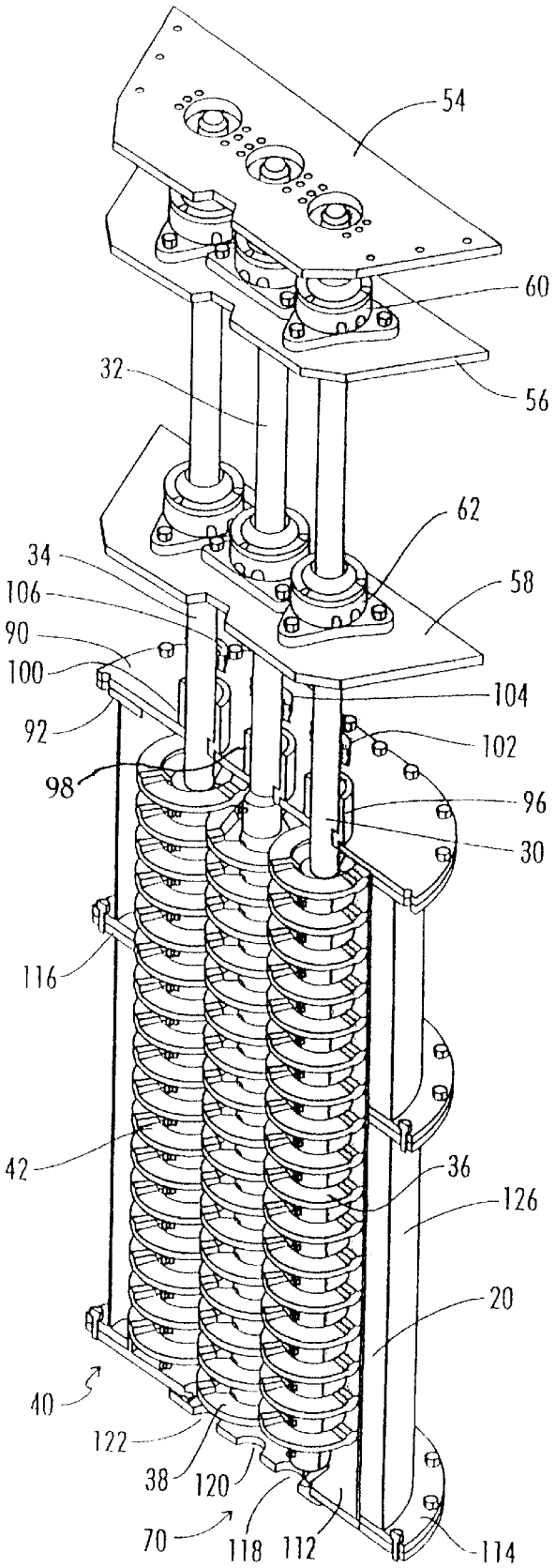
FIG. 2 shows a perspective cutaway view of the grinding chamber of the present invention. Three disc arrays are shown mounted on three rotatable shafts; the shafts are mounted lengthwise within the grinding chamber.

The present invention includes a media mill 10. The media mill 10 shown in FIG. 1 comprises a base 12. Typically the base 12 includes a mounting base 14. The media mill 10 further comprises a grinding chamber 20 supported by the base 12. A cutaway view of the grinding chamber 20 is shown in FIG. 2. The grinding chamber 20 includes three barrels 22 in fluid communication. The three barrels 22 are probably best shown in FIG. 3. The three barrels 22 generally include a first outer barrel 24, a second outer barrel 28, and a first inner barrel 26.

Figure 5A:
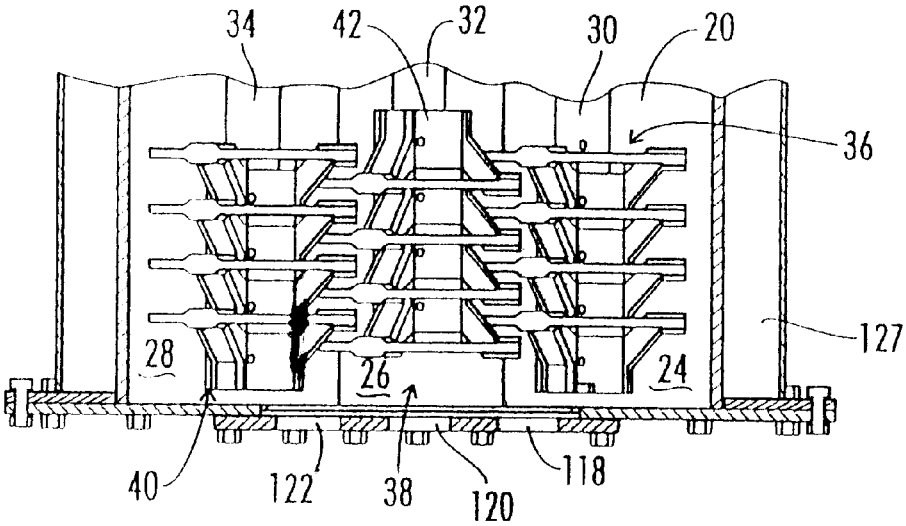
FIG. 5*a* shows a partial front view cutaway to show the shafts and disc arrays in the interior of the barrel section.
Figure 5B:
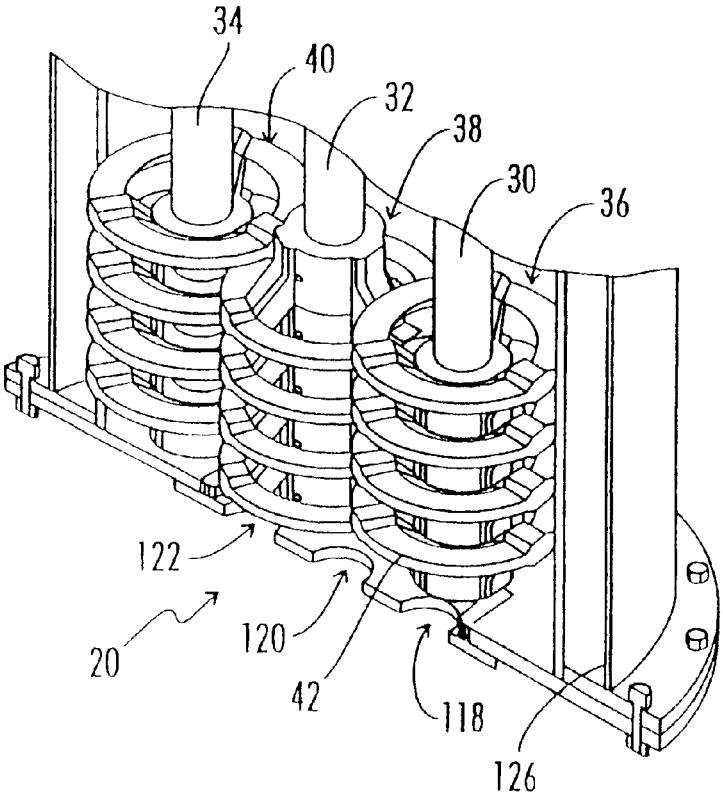
FIG. 5*b* shows a perspective view of the barrel section shown in 5*a*.

The media mill 10 further comprises a rotatable shaft operably disposed lengthwise in each barrel. This is probably best shown in FIG. 2, which depicts a rotatable shaft 30 disposed lengthwise in the first outer barrel 24, a rotatable shaft 32 disposed lengthwise in the first inner barrel 26, and a rotatable shaft 34 disposed lengthwise in the second outer barrel 28. A plurality of discs is attached to each shaft. FIGS. 2 and 5 show a plurality of discs or disc arrays 36 attached to shaft 30, disc array 38 attached to rotatable shaft 32, and disc array 40 attached to rotatable shaft 34. The disc arrays comprise individual discs 42.

The media mill 10 further comprises a power means 44 for driving the shafts 24, 26, and 28. The power means includes conventional driving means such as motors 46 shown in FIG. 1. In one embodiment the motors 46 include a first motor 48 connected to a first of the shafts.

In another embodiment, second motor 50 is connected to one of the other rotatable shafts. And a third motor 52 is connected to one of the other rotatable shafts i.e. the remaining shaft. In one embodiment the motors include hydraulic motors. In another embodiment the motors are bidirectional and include a variable speed control.

FIG. 2 shows a motor mount 54 on which the motors may be mounted. The rotatable shafts may be supported by an upper bearing plate 56 and a lower bearing plate 58 both of which are shown in FIG. 2. The upper bearing plate supports a plurality of upper bearing cases 60 within which the rotatable shafts rotate. The lower bearing plate 58 supports a plurality of lower bearing cases 62 within which the rotatable shafts rotate.

Figure 10:
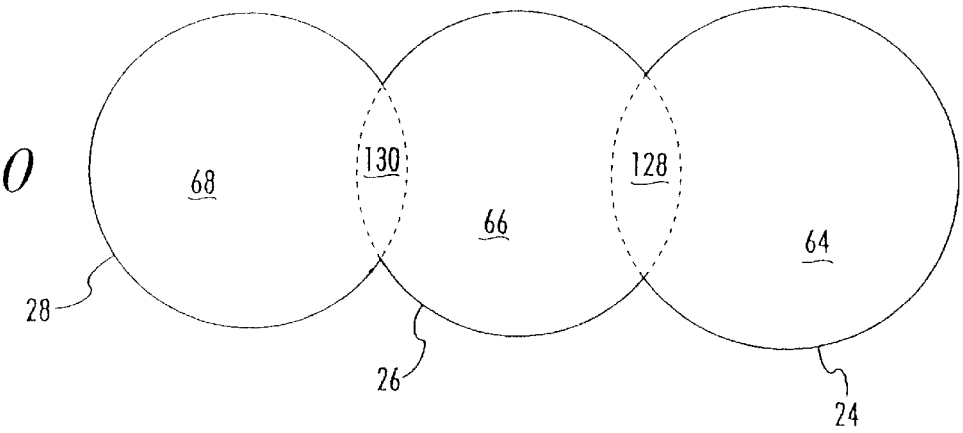
FIG. 10 shows a top down view of the grinding chamber comprising three barrels having central axes and intersecting wherein the central axes are circular cross-sections aligned in a common plane.
Figure 11:
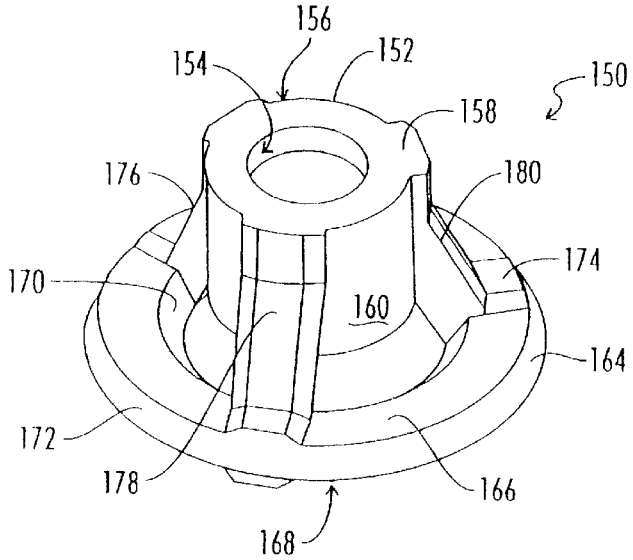
FIG. 11 shows a perspective view of a typical disc.
Figure 12:
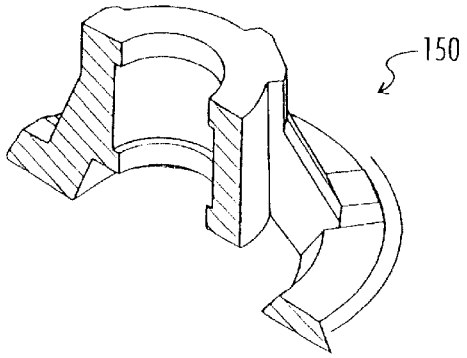
FIG. 12 shows a sectioned view of the disc shown in FIG. 11.
Figure 13:
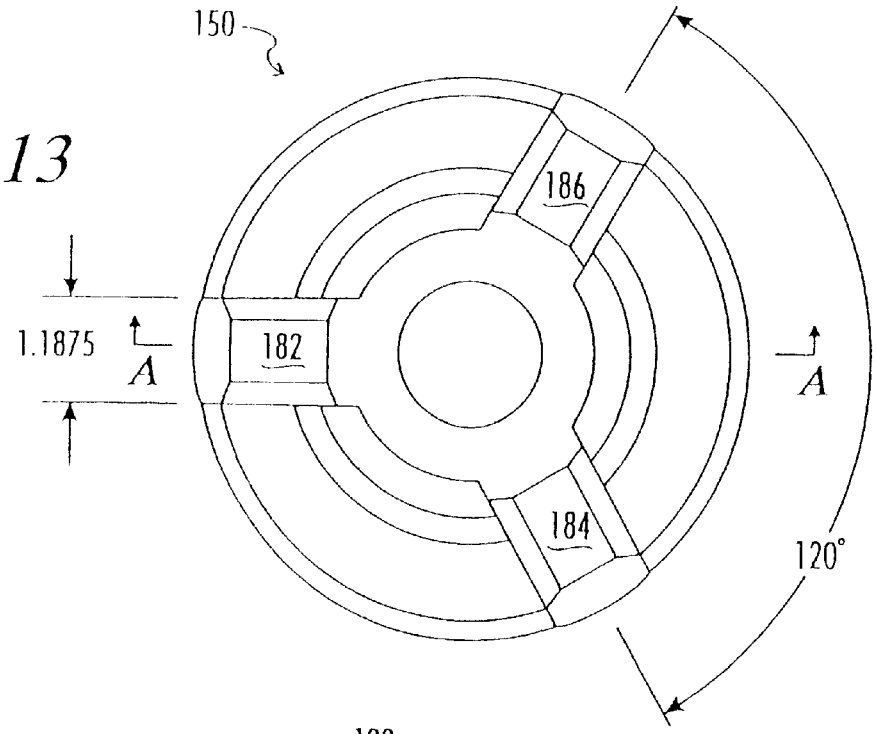
FIG. 13 shows a plan view of the disc shown in FIG. 11.
Figure 14:
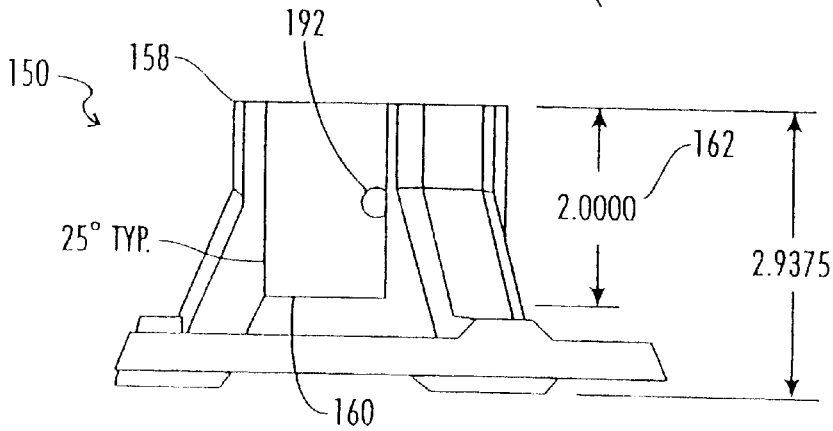
FIG. 14 shows an elevated side view of the disc shown in FIG. 11.
Figure 15:
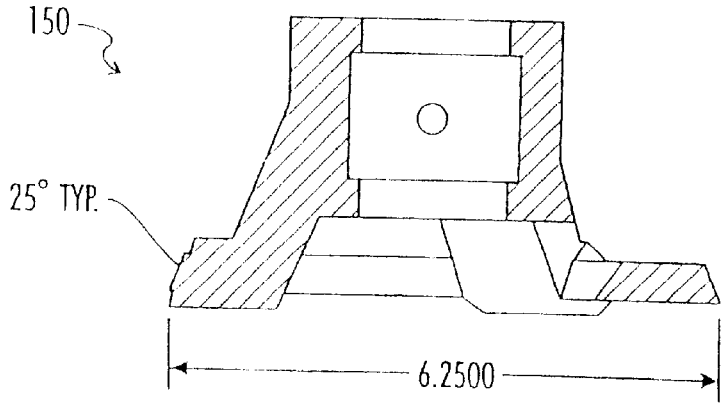
FIG. 15 shows an elevated side view of the disc shown in FIG. 13 cut along section line AA.
Figure 16:
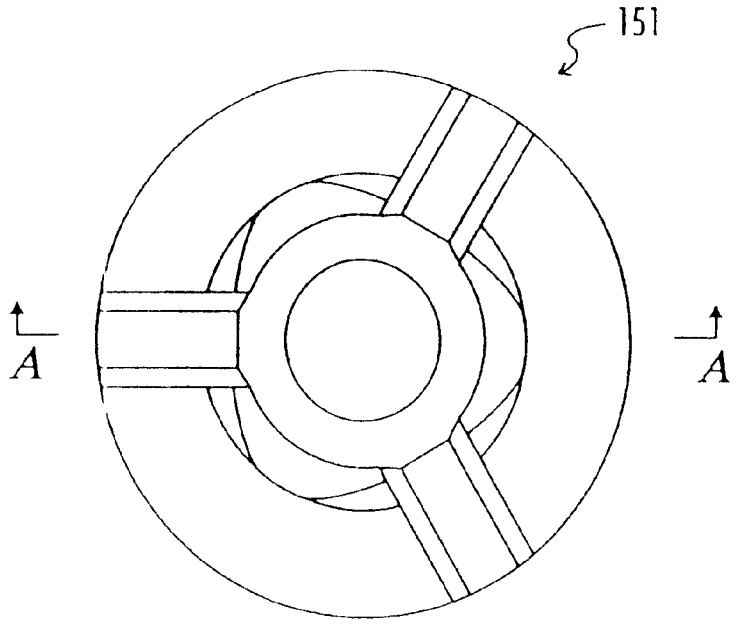
FIG. 16 shows a plan view of another embodiment of a typical disc.
Figure 17:
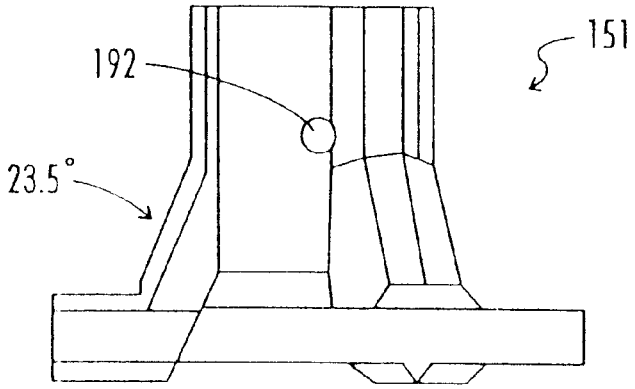
FIG. 17 shows an elevated side view of the disc shown in FIG. 16.
Figure 18:
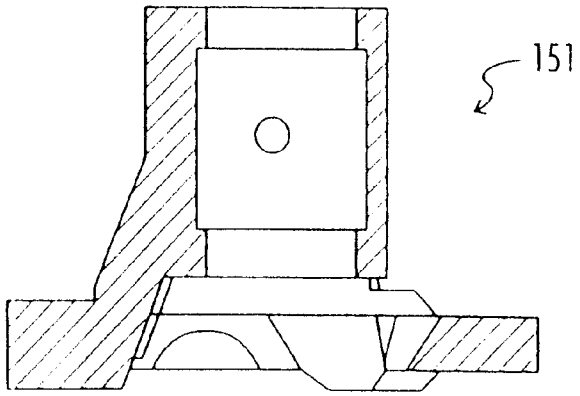
FIG. 18 shows an elevated side view of the disc shown in FIG. 16 cut along section line AA.
Figure 19:
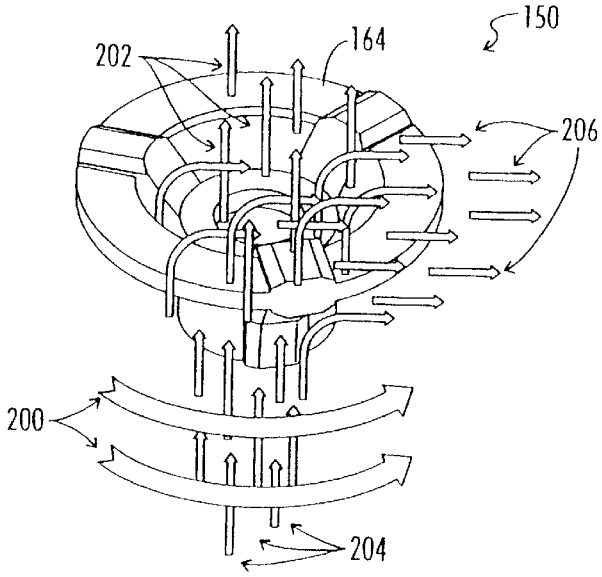
FIG. 19 shows a close up of the pumping action of a disc and the resultant media and product flow.

One preferred embodiment of the present invention is shown in FIG. 10.

FIG. 10 shows a top down view of the barrels 22. The barrels 22 comprise a first outer barrel 24, a second outer barrel 28, and a first inner barrel 26. Each barrel includes a circular cross-section 64, 68, and 66 respectively. The first outer barrel cross-section 64 intersects the first inner barrel section 66 and the second outer barrel cross-section 68 intersects the first barrel cross-section 66. This is shown with overlapped dashed lines.

In one embodiment of the media mill 10 the discs 36 attached to the first outer shaft 30 disposed in the first outer barrel 24 are partially overlapping and interposed with the discs 38 attached to the shaft 32 disposed in the first inner barrel 26. This is shown in FIGS. 2, 5*a,* and 5*b.* The disc 40 attached to the shaft 34 disposed in the second outer barrel 28 are partially overlapping and interposed with the discs 38 attached to the shaft 32 disposed in the first inner barrel 26. Typically the first outer barrel 24, the first inner barrel 26, and the second outer barrel 28 are arranged such that their central axes lie in a common plane. See in FIG. 10.

In one embodiment of the present invention the rotatable shaft 32 in the first inner barrel 26 is rotated slower than the rotatable shafts 30 and 34 in the two outer 20 barrels 24 and 28, respectively. This results in particulate matter tacking up. This is shown best in FIG. 6 where flow arrows 134, 136, and 138 show product and media flows. The rotational direction of the shafts is indicated by the circular arrows 140, 142, and 144; fewer circular arrows beneath the central shaft 32 than the two outer shafts 30 and 34 indicate the central shaft is being rotated slower than the two outer shafts.

Figure 7:
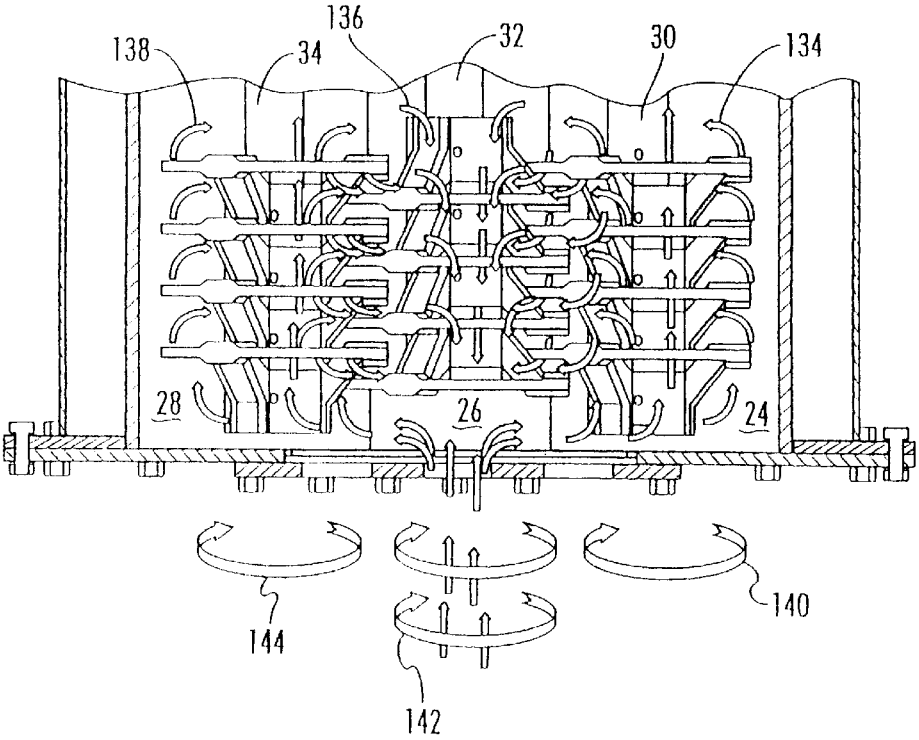
FIG. 7 shows a cutaway view of a barrel section depicting tack-shear grinding process wherein the shafts are rotated to achieve a tacking down mode of operation. Product and Media flow directions are shown for comparison to FIG. 6.

FIG. 7 depicts a cutaway of the barrel section or grinding chamber 20. FIG. 7 depicts a tack-shear process in a tacking down operational mode. For a tacking down process the center shaft 32 is rotated in the same direction as the outer shaft 30 and 34, however the center shaft 32 is rotated at a higher rate of speed than the outer shafts. This is indicated by multiple rotational speed arrows 142 shown in FIG. 7. Flow arrows 134, 136, and 138 indicate the direction of media. The higher and lower rates of rotational speed are typically accomplished through use of a first motor 48 connected to the center shaft 32 wherein the first motor 48 includes a variable speed control. In other embodiments the second and third motors 50 and 52 connected to the first and second outer shafts, respectively, include variable speed control as well. Preferably the variable speed control includes infinite control adjustment.

Tacking is essentially a process by which the speed differentials between the rotating discs stretch, generally through a pulling force, the molecular structure of the matter being ground. This is particularly relevant for crystaline structures. Stretching crystaline structures results in a deeper color.

Tacking up is a process in which, preferably, the outer discs are rotated faster than the inner disc. Particulate matter leaving inner disc is pulled by the high speed outer discs. Using two sets of outer discs, compared to one set of inner discs, results in greater surface area on the outer discs than the one inner disc. This also has a stretching, or pulling effect, because the molecular structure is spread out over a greater surface area.

Thus, tacking down, a process in which the inner discs are rotated higher than the outer discs also produces a stretching effect. However, the resultant shear is less than that produced by a tacking up process in which the speed differential adds to the tacking.

The ability to vary the relative rotation speeds is particularly useful for adjusting the grinding process to match the product to be ground.

Shear grinding occurs simultaneous with tacking. Shear grinding results from force vectors acting in generally opposing directions on generally opposing sides of a given particulate matter. This results in the molecular matrix of the particulate matter being sheared. A simplified two-dimensional example involves taking opposite corners of a square and pulling them apart while keeping the sides straight. The result is a sheared square having a shape that resembles a diamond shape, or two isosceles triangles joined at a common base.

The ratio of shear grinding to tack grinding is a function of the relative speeds of the shafts. Likewise, the ratio or grinding factor of impact grinding to tack-shear grinding to slurry grinding is a function of the rotation of the discs. The resulting grind ratios are also referred to as grind factors.

Lower viscosity products, such as those that are water based, result in more shear for a given set of rotational speeds than does high viscosity products, for example resins and epoxies.

Figure 8:
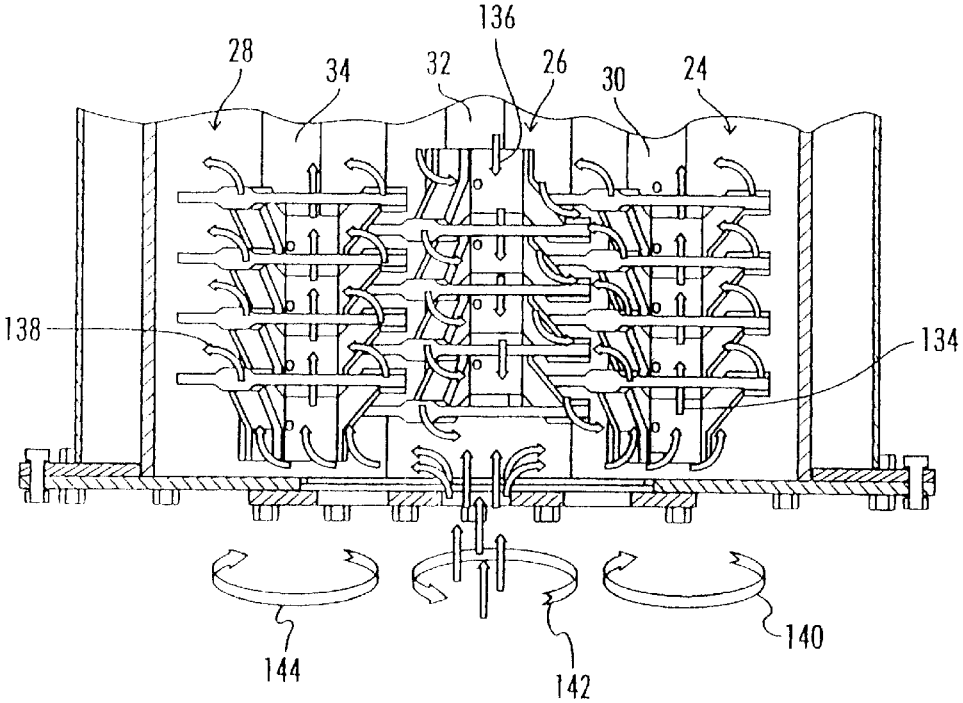
FIG. 8 shows a cutaway view of the barrel section depicting a slurry grinding mode of operation.
Figure 9:
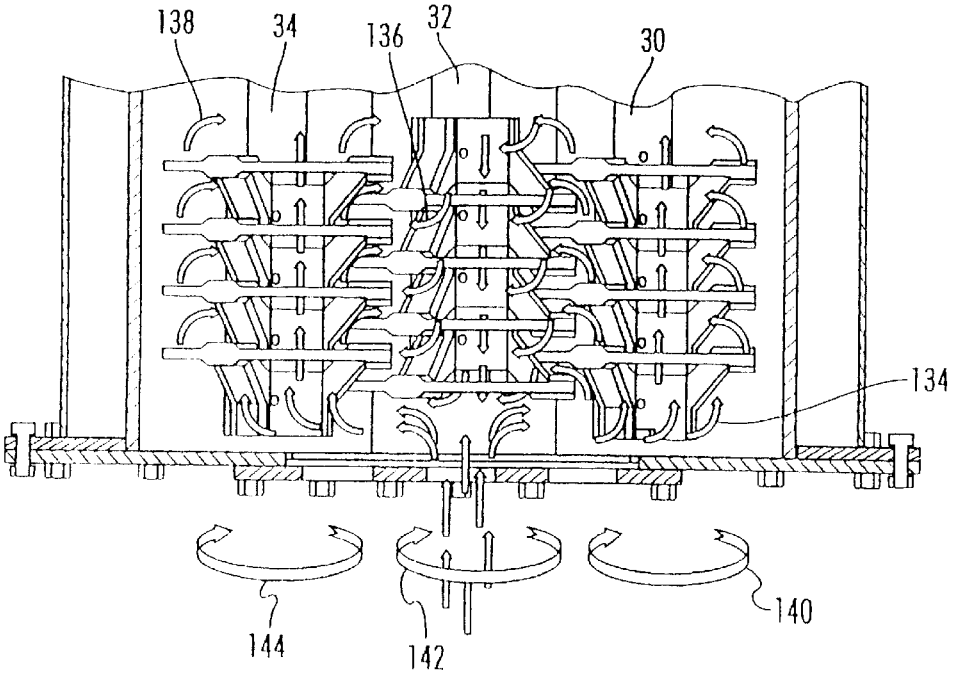
FIG. 9 shows a cutaway view of the barrel section depicting an impact grinding mode of operation.

Slurry grinding is simply a type of mixing or stirring process. FIG. 8 shows a cutaway of the barrel section.20 and depicts a slurry process. The slurry process is accomplished by counter rotating the central shaft 32. This is accomplished through use of a first motor 48 having bidirectional control. The bidirectional control is useful because the same shaft 32 can then be rotated in the same direction as the two outer shafts 30 and 34 without changing motors 46. Common rotation is shown in FIG. 9. FIG. 9 depicts an impact process which typically uses shafts rotating in a common direction.

In one embodiment of this invention, the media mill includes power means 44 comprising independent driving means 46, also referred to herein as motors 46, for driving a first of the rotatable shafts disposed in the barrels independent of another of the shafts disposed in the barrels. Thus, either one of the rotatable shafts 30, 32 and 34 can be rotated independently of the other two shafts. Preferably the independent driving means includes a bi-directional variable speed motor.

In one embodiment the media mill 10 includes power means 44 comprising tacking means for tacking particulate matter. Typically the tacking means will comprise a bidirectional variable speed control. This tacking creates a form of shear grinding referred to as tack-shear grinding. However, simply running one of these shafts, preferably the central shaft, at a higher rate of speed, or a lower rate of speed, relative the outer shafts 30 and 34 will accomplish tacking of particulate matter. The tacking means need not include bidirectional capability nor variable speed control.

Preferably the media mill 10 further includes tack-shear grinding means for performing tack-shear grinding in excess of a 3 percent tack-shear grinding factor. Again this may be accomplished in any conventional manner which allows, preferably, the central shaft to be rotated faster or slower than the outer shafts. The advantage to the tack-shear grinding is that it stretches particulate matter having a crystalline structure. The reason it is an advantage to stretch the crystalline structure is that a deeper color is achieved than when the crystalline structure is broken, i.e. a color with more depth, not just a deeper hue. A crystalline structure is typically broken during an impact or slurry grinding process. This form of tack-shear grinding is particularly relevant for fluorescents (i.e. fluorescent color pigments) which have a crystalline structure.

The percent grinding factor is the ratio of one type of grind to another. Utilizing a three barrel, three shaft design, such as described herein, all three generally occur simultaneously. The relative ratios, or grinding factors, are adjusted by adjusting the relative speeds. Thus, different products requiring different grinding requirements can be accommodated.

Thus, preferably the media mill 10 includes independent driving means 58 further comprising bidirectional driving means for driving the first shaft 26 in two directions. Typically the driving means is a bi-directional motor connected to the first shaft 32.

One embodiment of the media mill 10 includes three barrels comprising a central barrel 26 wherein the first shaft 32 is connected to the bidirectional motor 48 and the first shaft 32 is disposed in the central barrel 26.

Figure 3:
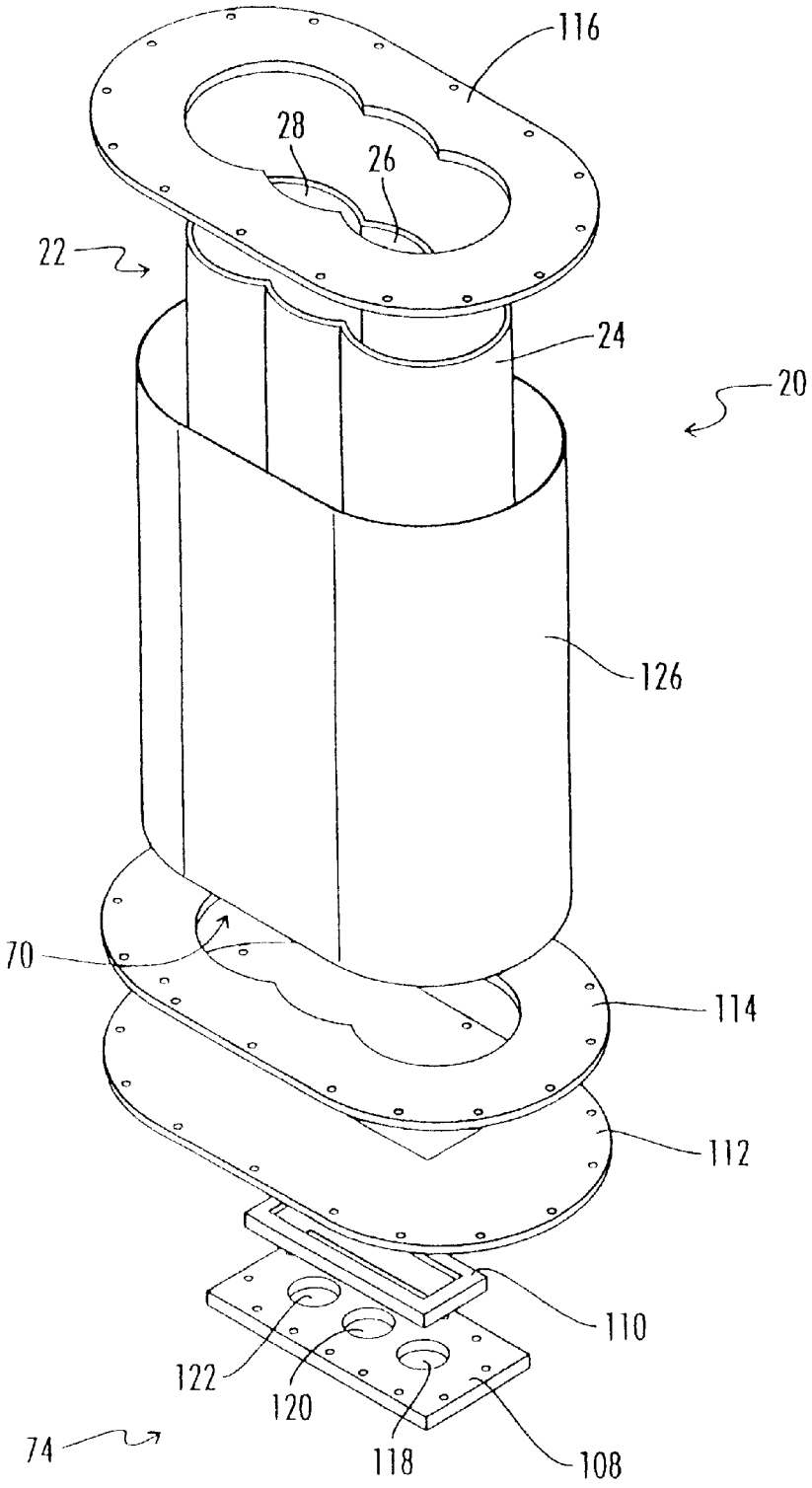
FIG. 3 shows a partially exploded perspective view of the grinding chamber.
Figure 4:
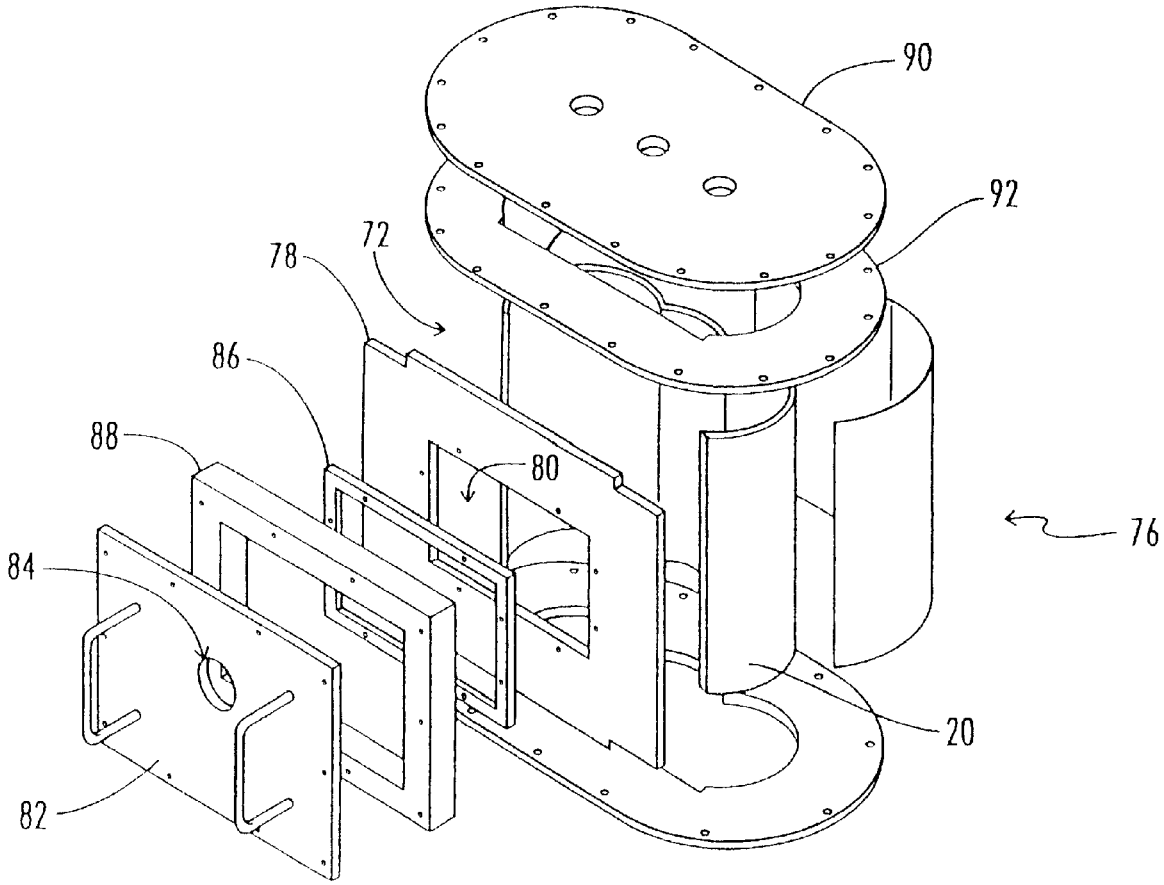
FIG. 4 shows a partially exploded perspective view of the discharge screen section.

In one embodiment of the invention the media mill 10 further comprises the grinding chamber 20 including an inlet 70 and an outlet 72. The inlet 70 shown in FIGS. 2 and 3 includes a lower feed or lower feed system 74. The feed system 74 is in fluid communication with the inlet 70 of the grinding chamber 20. A discharge screen 76 is fluid communication with the outlet 72 of the grinding chamber 20. The discharge screen is shown in FIG. 1 and an exploded view of the discharge chamber 76 is shown in FIG. 4.

In one embodiment the discharge screen 76 comprises a front plate 78 proximate the outlet 72 of the grinding chamber 20. The front plate 78 defines an opening 80 therein in fluid communication with the outlet 72 of the grinding chamber 20. The discharge screen 76 further comprises a discharge plate 82 defining an opening 84 in fluid communication with the front plate opening 80 and wherein the front plate 78 is positioned between the discharge plate 82 and the outlet 72 of the grinding chamber 20. The outlet 72 is best shown in FIG. 4. (Discharge opening 84 is shown in FIG. 1.) The discharge screen 76 further comprises a screen 86 positioned between the front plate 78, opening 80, and the discharge plate opening 84. This is shown in FIG. 4. FIG. 4 also shows a discharge plate mount 88 positioned between the discharge screen 86 and the front discharge plate 82. In the embodiment shown in FIG. 4 the discharge opening 84 is smaller than the front plate opening 80.

In one embodiment of the invention the media mill 10 comprises a grinding chamber 20 including a seal plate 90. This is shown in exploded view in FIG. 4 and in a cutaway view in FIG. 2. The rotatable shafts 30, 32, and 34 extend through the seal plate 90. Also shown in FIG. 2 is a top flange 92 for the discharge screen. The top flange 92 is positioned between the seal plate and the barrel section 20. One embodiment of the invention includes a plurality of seal housings 96, 98, and 100. A respective one of the seal housings encircles a respective one of the shafts, the respective seal housing being attached or abutting the seal plate 90. In FIG. 2 the seal housing 96 encircles the first outer rotatable shaft 30. The seal housing 98 encircles the first inner rotatable shaft 32 and the seal housing 100 encircles the second outer rotatable shaft 34. A plurality of seals 102, 104, and 106 encircle the shafts 30, 32, and 34 respectively. Thus, a respective one of the seals encircles the respective shaft and is positioned between the respective shaft and the respective seal housing.

For illustration purposes, the seals shown in FIG. 2 are not seated within the seal housing. Operationally the seals would be seated in the seal housing and preferably a second seal would rest on top of the first seal. In one embodiment of the invention each seal housing comprises bronze material and each seal includes carbon material. Preferably, the seal is made of a carbon fiber composite.

In one embodiment of the invention the media mill 10 includes a feed system 74 including a feed port 108. This is shown in FIG. 3. In the embodiment shown on FIG. 3, the feed system is a lower feed system. The feed port 108 is in fluid communication with the grinding member 20, or barrel chamber 20. In one embodiment a screen 110, also referred to as a feed screen 110 is positioned between the feed port 108 and the grinding chamber 20. The feed port 108 in one embodiment comprises three barrel openings 118, 120, and 122 in respective fluid communication with the three barrels 24, 26, and 28, respectively. This is probably best shown in FIG. 5*a*.

The media mill 10 in one embodiment, further comprises a water cooling jacket 126 around the grinding chamber 20. This is shown well in FIGS. 2 and 3. The water cooling jacket is spaced apart from the barrel 20 or grinding chamber 20. An interstitial space between the barrels 22 and an inner wall of the water cooling jacket 126 is also referred to as a water chamber 127. See FIG. 5*a*. The water chamber 127 may be filled with water, oil, or other substances for cooling as well as heating the grinding chamber. Therefore, the water cooling chamber is both an attenuation and an accentuation device. The water cooling jacket 126 is described more fully in U.S. patent application Ser. No. 09/039,716 by Ranne, B. H., et al., filed on Mar. 16, 1998, entitled "Double Barrel Media Mill For Grinding And Dispersing Particulate Matter And Pigment For Paint, Coatings, Link And Other Fluid Pigment Vehicles" which is hereby incorporated by reference.

One embodiment of the present invention includes a media mill 10 comprising a base 12; a grinding chamber 20 supported by the base 12; a plurality of rotatable shafts 30, 32, and 34 likewise disposed in the grinding chamber 20. The plurality of shafts 30, 32, and 34 include a central shaft 32, a first outer shaft 30, and a second outer shaft 34. A plurality of discs 36, 38, and 40 are spaced along each shaft, respectively. The discs 38 spaced along the central shaft 32 partially overlap the discs 36 and 40 spaced along the two outer shafts 30 and 34. The media mill 10 further comprises drive means 46 for rotating each shaft 30, 32, and 34 independent of the other shafts. The drive means 46 is connected to the shafts. In one embodiment the drive means 46 comprises a variable speed bidirectional motor 48 connected to each shaft.

In one embodiment the grinding chamber 20 comprises a central barrel 26 and two outer barrels 24 and 28, each barrel having a circular cross-section 64, 66, and 68. See FIG. 10. The cross-section 66 of the central barrel 26 intersects the cross-sections 64 and 66 of the two outer barrels 24 and 28. The central shaft 32 is disposed in the central barrel 26 and the two outer shafts 30 and 34 are respectively disposed in the two outer barrels 24 and 28. The media mill 10 may further comprise a discharge screen 76 in fluid communication with the grinding chamber 20. The media mill 10 may also include a water cooling jacket 126 around the grinding chamber 20.

Another embodiment of the present invention is a chamber 20 for use with a media mill 10. Chamber 20 comprises a first barrel portion 24; a second barrel portion 26; and a third barrel portion 28, where the second barrel portion 26 is in fluid communication with the first and third barrel portions 24 and 28. Each barrel portion typically comprises a circular cross-section 64, 66, and 68 where the cross-section of the second barrel 66 intersects the cross-sections of the first and third barrel portions 64 and 68, respectively. Preferably each barrel portion lies in a common plane. See FIG. 10.

The chamber 20 of the present invention may also comprise a shaft disposed in each barrel portion; and a plurality of discs spaced along each shaft. See FIG. 2. The chamber 20 may further comprise a discharge screen 76 in fluid communication with one of the barrel portions. Preferably the discharge screen 76 is in fluid communication with all of the barrel portions.

While the apparatus of the present invention has been substantially described with respect to a vertical media mill where particulate matter is generally fed in to the lower portion and ground, slurried, sheared, tacked, or impacted and discharged through the top portion, other variations will be obvious to those who are skilled in art. For example, the media mill may be horizontal. The inlets and outlets can be operationally spaced as desired. The central axes of the shafts need not lie in a common plane. Nor are the discs required to be of the same size. Other modifications and embodiments will be apparent from the disclosure herein.

The present invention also includes a method of mixing particulate matter comprising providing a mill 10 including a chamber 20 having a first outer chamber portion 24, a second outer chamber portion 28, and a central chamber portion 26. The method further includes propelling particulate matter from the first outer chamber portion 24 towards the central chamber portion 26; propelling particulate matter from the second outer chamber portion 28 toward the central chamber portion 26; and propelling particulate matter from the central chamber portion toward the first outer chamber portion 24 and the second outer chamber portion 28. This should be done in such a manner that the particulate matter from the central chamber portion intermixes with the particulate matter from the first outer chamber portion 24 at a first outer boundary 128 between the first outer chamber portion 24 and the central chamber portion 26, and such that particulate matter from the central chamber portion 26 intermixes with particulate matter from the second outer chamber portion 28 at a second outer boundary 130 between the second outer chamber portion 28 and the central chamber portion 26. The particulate matter flow is best shown in FIGS. 6 through 9 and the boundary in FIG. 10.

The first outer portion particulate matter flow is indicated by arrows 134. The central portion particulate matter flow is indicated by arrows 136, and the second outer portion particulate matter flow by arrows 138. Rotational speed directional arrows 140, 142, and 144 are shown in FIGS. 6, 7, 8 and 9. Two speed directional arrows indicate a higher rate of speed than one speed directional arrow. The direction of rotation is indicated by the arrow head.

Figure 6:
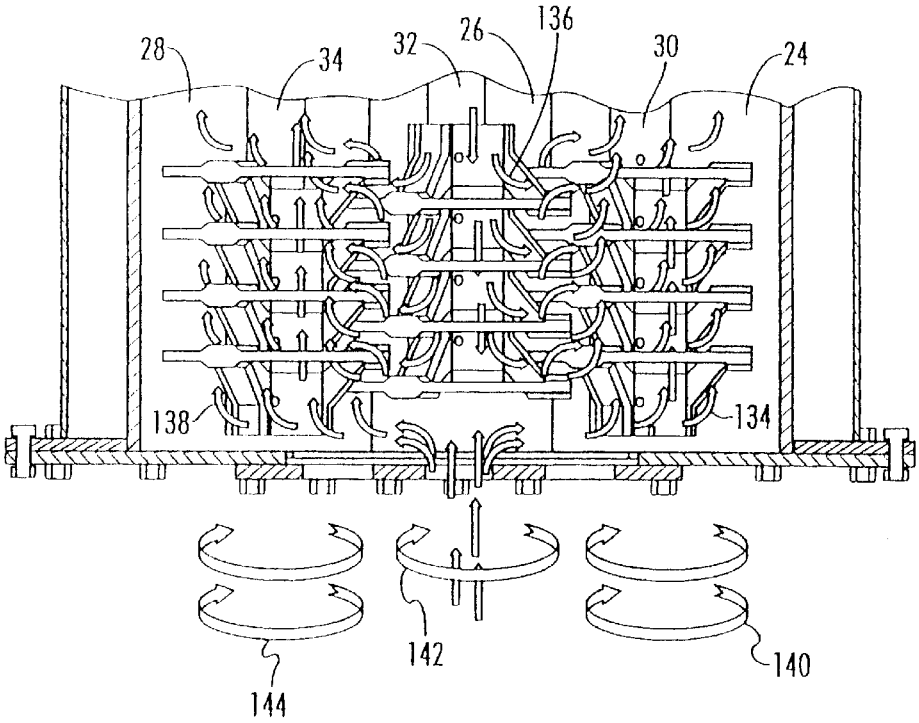
FIG. 6 shows a cutaway view of the barrel section depicting a tack-shear grinding process. Product and media flow arrows show a tacking up mode of operation.

FIG. 6 depicts a tack-shear process in which the central portion particulate matter 136 is rotated in the same direction as the outer portion particulate matter 134 and 138 but at a slower rate of speed. This results in a tacking up mode of operation.

FIG. 7 is a tacking down process where the particulate matter in the central portion 136 is rotated at a higher rate of speed than the particulate matter in the outer portions 134 and 138.

In FIG. 8 the particulate matter in the central portion 136 is counter rotated relative the particulate matter in the outer portions 134 and 138. This results in a slurry process of grinding.

FIG. 9 depicts an impact grinding process wherein the particulate matter in all three portions are rotated in the same direction and at the same rate of speed.

In a method of this invention the propelling steps comprise rotating the particulate matter in each chamber portion about an axis in each chamber portion. In FIGS. 6 through 9 the particulate matter is rotated about a vertical axis. In another method the rotating step comprise rotating the particulate matter 136 in the central chamber portion 26 in a common direction 142 relative to a first chamber portion rotation 140. This is depicted in FIG. 9 and generally results in an impact grinding process when the remaining shaft is rotated in a similar manner. In another method of this invention the rotating step comprises counter-rotating the particulate matter 136 in the central chamber portion 26 relative to particulate matter 134 being rotated in a first chamber portion 24. FIG. 8 depicts one such method. This can result in a slurry grinding process when the speeds and directions of the shafts are appropriately adjusted.

In a method of this invention the rotating step comprises rotating the particulate matter 144 in the second outer portion 28 at a rate of speed 144 equal to a first chamber portion particulate matter rotation speed 140 of another of the chamber portions 24. This is depicted in FIG. 7 and may result in a tacking down process. This mode of operation is also depicted in FIG. 8, however it results in a slurry grinding process because the central shaft is rotated differently than the central shaft shown in FIG. 7. This mode of operation is consistent with FIGS. 6 and 9. Again the resulting grinding process may be other than slurry, depending on how the rate of speed of the matter in the central chamber is varied and what direction of the matter in the central chamber is rotated.

In another method of this invention the rotating step comprises rotating the particulate matter 136 in the central portion 26 at a rate of speed 142 slower than a rate of speed 140 at which the particulate matter in a first chamber portion 24 is rotated. This is similar to what is depicted in FIG. 6. Another method comprises rotating the particulate matter 136 in the central chamber 26 at a rate of speed 142 higher than a rate of speed 140 at which the particulate matter 134 in a first chamber portion 24 is rotated. This is similar to FIG. 7. One method of the present invention includes rotating particulate matter 136 in the central chamber 26 in a common direction 142 relative the particulate matter 134 being rotated in the first of the chamber portions 24.

While select rotation directions and speeds have been described for exemplary purposes it will be apparent to those skilled in the art that a multitude of operational modes may be achieved through various combinations. The present invention is not intended to be limited by such examples. Parameters should be varied to accommodate particular grinding needs. The present invention teaches an apparatus capable of accommodating these needs and methods of satisfying these needs.

Another method of this present invention further comprises the step of tack-shear grinding of particulate method. The step of tack-shear grinding may further comprise stretching a crystalline structure. This is one method of achieving a greater color depth because the crystalline structure is stretched rather than broken.

The present invention may also be used in a continuous flow mode. It includes three types of grinding: impact, slurry, and tack-shear. The working mechanism of the three barrel mill preferably comprises three individually powered shafts. Attached along the length of the shafts are arrays of specially designed casts- stainless steel, or alloy, discs. These arrays of discs are staggered with discs overlapping. Each shaft may be individually powered by hydraulic motor. The speed and rotational direction of the outer shafts are concurrent in some embodiments, however the speed may be infinitely controlled from zero rpm to the upper limits of the motor. Directional rotation may be concurrently changed. The center shaft is generally independently controlled from the outer shafts. Speed control is preferably infinite within the limitations of the power source and directional rotation and it may be reversed as well.

The possibilities made available by adding the central barrel and subsequent discs array are paramount in distinguishing the three barrel mill from any single or two barrel mill in existence. By being able to control the mechanism action of the central shaft or another shaft, all three grinding processes may be accomplished with a single multi-barrel mill.

A variety of combinations utilizing continuous variable speed bidirectional motors having continuous speed control leads to an infinite number of permutations within one or all three grinding processes. For impact grinding, the rotation direction of all three shafts is clockwise or counter clockwise. This is a standard mode for impact grinding. For impact grinding all three shafts will be rotated at the same speed typically. This action yields maximum impact and grind rate and an amount can be precisely controlled by simultaneously adjusting the speed of all three shafts. By rotating all three shafts in the same direction, any vortex flow is eliminated and a significantly high percentage of expended energy units is transferred to actual work units as compared to a conventional media mill.

This is also assisted by deploying specially designed discs throughout the disc arrays. The discs, designed with pods and vanes that work similar to an impeller in a turbine or pump. The discs impart a pumping action within the mill to assist in quick and total product dispersion. Chamfers on the veins and pods cause additional pumping action and propel product and media multi directionally along the directional rotational axis of the shaft assembly. A combination unidirectional rotation of shafts and unique disc design promote fluid dynamic and mechanical actions that virtually eliminate barrel wear.

Slurry grinding is accomplished by reversing the direction of rotation of the central shaft relative the two outer shafts. For maximum slurry grinding to occur all three shafts should be run at the same rotational speed. The combination of the mechanical action of the discs' fluid dynamics created by the opposing rotational flows will cause media and product, also referred to herein as particulate matter, to be "stirred" and consistently dispersed about the mill chamber, or grinding chamber. Slurry grind rate and grind amount can be varied by adjusting the rotational speed of the shafts, preferably simultaneously. A significant increase in product quality and grind consistency in dispersion is achieved using the three barrel mill relative to slurry grinding in a single or two barrel mill. This is believed to be due, to a large degree, to unique fluid dynamics created by opposing rotational forces of a third barrel and associated disc array.

The three barrel mill is unique in that it can perform noticable tack-shear grinding. This task is not feasible to any significant amount, on a single or double barrel mill. This has typically-been relegated to roller mills and various kneader mills. Even so, none have been able to effectively perform all three types of grinding. Also, due to the design and configuration of a three barrel vertical mill, performance gains will be logarithmic as compared to conventional tack-shear grinding techniques.

To effect tack-shear grinding, all shafts should rotate in the same direction. The speed, however, of the outer shafts, or the central shaft, may be varied depending on the amount of shear, or tack, grinding needed. By varying the speed of these shafts one may be able to tack up or tack down to any desired precision. To achieve maximum shear one should rotate the central shaft at a lower speed than the outer shafts. The differential created by this mode of operation dictates that fluid dynamics draw the product up towards the faster rotating faster shafts thereby causing maximum shear grinding to take place along with the tacking, thus fulfilling the criteria of tacking up. Conversely the mill can be configured to tack down by rotating the center shaft at a higher speed than the two other shafts. Having the capability to ultimately control the ratio of speed between the outer shafts and the center shaft is desirable to achieve very precise control over the grind rate and the quality of the grind.

The independently powered third shaft permits the mill to be started and ramped up with the center shaft rotating in an opposite direction. This eliminates the need to use an overpowered motor to overcome the inertia of media and product in the chamber. This feature is particularly helpful in powering and ramping up the mill when the products to be processed are tacky or sticky.

Typical particulate matter includes coatings, pigment dispersion, color concentrates, inks, thermal inks, textiles and leather dyings, magnetic coatings, adhesives, common plastics, mineral toners, pharmaceuticals, and high technology ceramics. This mill also provides the ability to grind carbon blacks. It is particularly well suited to stretching products having crystalline structures.

The addition and functional implementation of a third barrel with associated apparatus (shaft, disks, and independent, bi-directional, variable speed hydraulic power unit) constitutes an innovative approach to media grinding mills that is unprecedented in the history of the industry. Utilizing contemporary technologies, consumers often need two or more devices to accomplish a combination of the three types of grinding (impact, slurry, and tack-shear) effectively. The three barrel media mill virtually eliminates this need by providing these grinding methods both effectively and efficiently in one machine.

| | 1 - Barrel Mill | 2 - Barrel Mill | 3 - Barrel Mill |
|---|---|---|---|
| Impact | 2% | 2%–75% | 2%–75% |
| Tack-shear | 3% | 3% | 3%–60% |
| Slurry | 95% | 20%–95% | 20%–95% |

Configuration and Action of Two Outer Barrels

The outer two shafts and disks are independently powered by bidirectional, variable speed hydraulic units. Speed and directional control to the two outer shafts is concurrent, both running at the same speed and direction at the same time. Directional rotation of these shafts may be reversed. Variable speed control of the two outer shafts permits both low and high speeds. High speeds of the outer shafts impart maximum impact to the product. Conversely, slow speeds provide minimum impact and optimum slurry grinding.

Configuration and Action of Inner Barrel

The inner shaft is independently powered and controlled from the two outer shafts. The unit may be started with the center shaft started in an opposing rotational direction from the outer shafts which will reduce excessive power needs for starting. Operating the unit in this mode will yield a 2% impact factor. Thus, impact grinding will be reduced to approximately 2% with the remaining 98% of the grinding comprising slurry and tack-shear. For optimal impact operation all shafts will run in the same direction at the same speed. Variable speed control over the center shaft will control the amount of impact to tack-shear grinding.

When the center shaft is rotating slower than the outer shafts the material is tacking to the outer shafts, or tacking up. Inversely, when the rotational speed of the center shaft is faster than that of the outer shafts, the material is tacking from the outer shafts, or tacking down. Tacking down imparts more tack-shear to the product.

Speed and rotational settings may be determined and individualized for each pigment type whether it be impact, slurry, or tack-shear or any combination of each. Totally enclosed vessel reduces the viscosity wear due to loss of solvent. Also since significantly less needed solvent is needed, a substantial amount of money is saved. This also reduces the amount of waste solvent generated.

A more detailed discussion of the discs, or impellers, follows. Reference should be made to FIGS. 11–21 which show embodiments of a disc 36 for a disc array 38 denoted as a media mill disc, or simply disc, 150.

One embodiment of the media mill disc 150, which is adapted to mount on a shaft of a media mill, includes a hub 152 having an inner diameter 154, and an outer diameter 156 larger than the inner diameter 152, a first end 158, a second end 160, and a length 162 between the first end 158 and the second 160 end, wherein the inner diameter 154 is adapted to mount on the shaft of the media mill. Typically a roll pin, not shown, is insert through mounting hole 192. It is convenient to define the direction "up" as corresponding to the first end and "down" as corresponding to the second end. This is not intended to limit the orientations in which the disc may be used.

The disc 150 also includes a planar disc blade 164 spaced a distance apart and downward from the second end 160 of the hub. Preferably the hub 152 is normal to the planar disc blade 164. The planar disc blade 164 includes a first surface 166 and a second surface 168 spaced apart from the first surface 166. This defines the thickness of the planar disc blade 164. The first surface 166 is arranged closer to the hub 152 than the second surface 168. The planar disc blade 164 also includes an inner chamfer 170 and an outer chamfer 172.

The disc 150 also includes a plurality of equidistant vanes 176, 178, 180 extending angularly downwardly and radially from the hub 152 to the planar disc blade 164.

Figure 20:
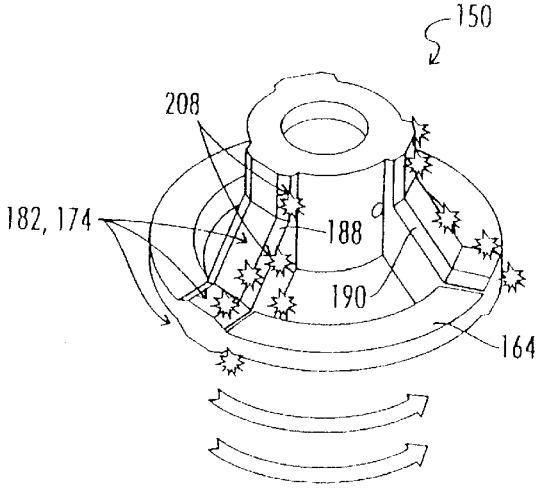
FIG. 20 shows exemplary locations of increased bumping or impacting on the impeller due to the angular vanes and bumps or pods.
Figure 21:
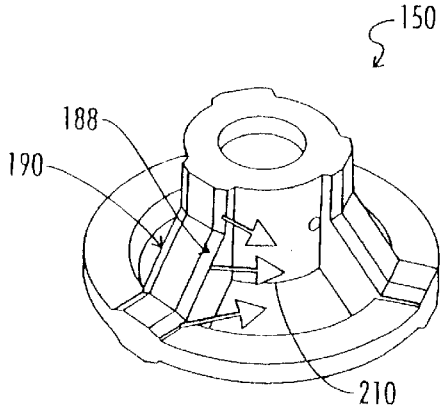
FIG. 21 shows resultant multi-directional flow, or impact force, due to the chamfers and the vanes being at different angles from each other.

Preferably the planar disc blades includes a plurality of raised pods 174 spaced about the first and second surfaces 166 and 168. Each vane includes respective raised pods 182, 184, and 186. The vanes and pods typically include windward and leeward chamfers 188 and 190, respectively The windward 188 and leeward 190 chamfers are best shown in FIG. 20. The vanes typically have windward and leeward surfaces corresponding the direction of rotation. The surface rotating into the fluid is windward, correspondingly, the opposing surface is leeward. The downward angle for the vanes is typically 26 degrees, relative a vertical axis, for the 6.25 inch disc 150; and 23.5 degrees for the 4 inch disc 151. The features shown in a disc of a particular size are not necessarily unique to that size disc.

These discs are typically cast from stainless steel and may be investment cast utilizing 28% chrome. The chrome add substantial hardness. Hardened stainless steel 440C was employed to both provide a contaminant free operating environment and to greatly enhance longevity and durability of the disc. Similar disc have been tested in multi-barrel media mills. Typically 6½ inch discs will be used in 8 inch barrels and 4½ inch discs will be use in 6½ inch barrels. However, these discs may be cast in variety of sizes up to 12 inches in diameter without substantial change to the fluid dynamics. The thickness of the planar disc blades is typically 0.375 inches for the 6.25 inch disc and the 4.5 inch disc. The thickness between the surfaces of raised pod locate on the top and the bottom of the planar disc blade are typically 0.625 inches These discs were primarily developed for use in multi-barrel mills. But other applications will be apparent to those familiar with media mills in general. The discs play an important part in the efficiency of the overall process of these mills and are an important part of the total process. It is believed that no pod discs are currently on the market that implement this particular design and mechanism of action.

These discs are designed to be stacked on and affixed to a shaft leaving, preferably, none of the shaft exposed throughout the array of discs. This permits easy cleanup and eliminates contamination in subsequent, but different material batches. Noting the design of the disc, its configuration is somewhat similar to an impeller. The disc 150, as it rotates 200, imparts a pumping mechanism 202 of action to both raw material and grinding media 204. See FIG. 19. As raw product 204 is mechanically pumped 202 into the mill, the action of the discs serves to physically augment the pumping. The resultant flow of product and media 206 cause by the pumping action is shown parallel to the planar disc blade 164 because the disc 150 will typically have another disc stacked on top (and bottom) of it, whereby the flow is outward and between the blades 164.

The pods are preferably raised 3/16 inch on the 6½ inch disc and ⅛ inch on the 4½ inch disc. Raised pods are utilized on the both top and bottom of the planar disc blade to further facilitate this pumping 202 action and to create a bumping action 208, see FIG. 20. The resulting impetus of an array of the discs creates maximum dispersion of product. Subsequent impact grinding applications will benefit greatly.

In slurry grinding applications, product dispersion will be more consistent as the mechanism of action is more uniform, constant and predictable. Use of the discs imparts mechanical actions in multi-barrel mills so that flitting and rat-holing are eliminated.

The disc comprises a great deal of symmetry. This facilitates rotating the discs in either direction (clockwise or counter-clockwise) without losing any of inherent effectiveness of the discs. This capability offers added functionality in multiple barrel mills, particularly in three barrel media mills. In three barrel mills, the discs may be mounted inversely (upside down) on one of the shafts, typically the center shaft. By independently regulating the speed of the center shaft, one may quite easily tack up or tack down a product. This process heretofore has been typically rigorous and extremely time consuming. The additional pumping action of the discs facilitates this process very effectively and efficiently in a properly configured three barrel mill.

As these discs are stacked in their respective arrays, singular or multiple, they have been designed to leave a clearance of ⅜ inches between the pods and vanes of adjoining discs along the shaft. This distance was chosen as an effective approach to providing optimum performance in the way of motion and disbursement of product and media. Increased surface area of the disc, which includes the vanes, raised pods, and chamfers transfer more working energy to the actual grinding process than any prior art of which the inventor is aware.

The raised pods and vanes have been designed with a very noticeable and distinct chamfer. The wide chamfer forces propulsion of product and media to be multidirectional 210 (see FIG. 21) and in stacks causes product and media to impact on itself rather than the mill mechanisms. This action will cause more efficiency and superior grind quality while virtually eliminating barrel wear in multiple barrel mills. This is due in part to the configuration of multiple barrel mills and the resultant fluid dynamics inherent by rotating three shafts with associated disc arrays in the same direction. The unique design utilizing pods and vanes increases pumping action to the product and media and facilitates achieving an optimum energy to work ratio The pods and vanes provide 'bump' and propulsion to product and media, greatly enhancing product dispersion and consistency, and efficiency of operation The unique chamfer design on the pods and vanes increases surface area and provides multidirectional motion of product and media.

Also, barrel wear is virtually eliminated in multiple barrel mills This is because the impact to the barrel is reduced since the impacting is among the fluid. Typical single barrels using typical grinding pods require resurfacing, or replacement approximately every 3000 hours of grinding. Multi-barrel grinding utilizing discs as described herein raise the barrel to, generally, at least 10 times that many hours between barrel maintenance. Typically 3 mm stainless steel shot is used. However, other media is often used for particular grinding and product requirements. The disc blades between impellers are typically spaced apart ⅜ inch to 5/16 inch, depending on the disc, the shot, and other performance requirements.

Thus, although there have been described particular embodiments of the present invention of a new and useful Multi-Barrel Media Mill and Methods of Grinding, it is not intended that such references be construed as limitations upon the scope of this invention except as set forth in the following claims.

What is claimed is:

1. A media mill comprising:

a base;

a grinding chamber supported by the base, the grinding chamber including three barrels in fluid communication;

a rotatable shaft operably disposed lengthwise in each barrel;

a plurality of discs attached to each shaft; and power means for driving the shafts;

wherein the three barrels comprise:

a first outer barrel, a second outer barrel, and a first inner barrel;

each barrel including a circular cross section;

and the first outer barrel cross section intersects the first inner barrel cross section and the second outer barrel cross section intersects the first inner barrel cross section;

wherein the discs attached to the shaft disposed in the first outer barrel are partially overlapping and interposed with the discs attached to the shaft disposed in the first inner barrel; and wherein the discs attached to the shaft disposed in the second outer barrel are partially overlapping and interposed with the discs attached to the shaft disposed in the first inner barrel.

2. The media mill of claim 1, wherein the first outer barrel, the first inner barrel, and the second outer barrel lie in a common plane.

3. The media mill of claim 1, wherein the rotatable shaft in the first inner barrel is rotated slower than the rotatable shafts in the two outer barrels, and wherein particulate matter tacks up.

4. The media mill of claim 1, wherein the rotatable shaft in the first inner barrel is counter-rotated relative to the rotatable shafts in the two outer barrels.

5. The media mill of claim 1, wherein the power means comprises independent driving means for driving a first of the shafts disposed in the barrels independent of another of the shafts disposed in the barrels.

6. The media mill of claim 5, wherein the power means comprises tacking means for tacking particulate matter.

7. The media mill of claim 6, further comprising tack-shear grinding means for performing tack-shear grinding in excess of a three percent tack-shear grinding factor.

8. The media mill of claim 5, wherein the independent driving means further comprises bi-directional driving means for driving the first shaft in two directions.

9. The media mill of claim 1, wherein the power means includes a first bi-directional motor connected to a first of the shafts.

10. The media mill of claim 9, wherein the first bi-directional motor comprises a variable speed control.

11. The media mill of claim 10, wherein:

the first shaft connected to the first bi-directional motor is disposed in the inner barrel.

12. The media mill of claim 11, wherein the first shaft disposed in the inner barrel includes a capability to be driven independent of the shafts disposed in the other barrels.

13. The media mill of claim 1, wherein the power means includes a variable speed motor connected to one of the shafts.

14. The media mill of claim 1, further comprising:

the grinding chamber including an inlet and an outlet;

a feed system in fluid communication with the inlet of the grinding chamber; and a discharge screen in fluid communication with the outlet of the grinding chamber.

15. The media mill of claim 14, wherein the discharge screen comprises:

a front plate proximate outlet of the grinding chamber, the front plate defining an opening therein in fluid communication with the outlet of the grinding chamber;

a discharge plate defining an opening in fluid communication with the front plate opening and wherein the front plate is positioned between the discharge plate and the outlet of the grinding chamber; and a screen positioned between the front plate opening and the discharge plate opening.

16. The media mill of claim 15, wherein the discharge opening is smaller than the front plate opening.

17. The media mill of claim 1, wherein the grinding chamber further comprises:

a seal plate through which the shafts extend;

a plurality of seal housings, a respective one of the seal housings encircling a respective one of the shafts, the respective seal housing being attached to the seal plate; and a plurality of seals, a respective one of the seals encircling the respective shaft and positioned between the respective shaft and the respective seal housing.

18. The media mill of claim 17, wherein each seal housing comprises bronze material and each seal includes carbon material.

19. The media mill of claim 1, further comprising a feed system including a feed port in fluid communication with the grinding chamber; and a screen positioned between the feed port and the grinding chamber.

20. The media mill of claim 19, wherein the feed port comprises three barrel openings in respective fluid communication with the three barrels.

21. The media mill of claim 1, further comprising a water cooling jacket around the grinding chamber.

22. A media mill for selectively providing variable proportions of slurry grinding, impact grinding and tack-shear grinding of a material received in the mill, comprising:

a base;

a grinding chamber supported by the base;

a plurality of rotatable shafts lengthwise disposed in the grinding chamber, the plurality of shafts including a central shaft, including a first outer shaft and a second outer shaft;

a plurality of discs spaced along each shaft, the discs spaced along the central shaft partially overlapping the discs spaced along the two outer shafts; and drive means for rotating the central shaft independent of the outer shafts, the drive means connected to the shafts, so that a rotational speed of the central shaft relative to a rotational speed of the outer shafts may be varied to control a degree of tack-shear grinding of the material received in the mill.

23. The media mill of claim 22, wherein the drive means comprises a variable speed bi-directional motor connected to each shaft.

24. The media mill of claim 22, wherein the grinding chamber comprises:

a central barrel and two outer barrels, each barrel having a circular cross-section; the cross section of the central barrel intersecting the cross sections of the two outer barrels; and the central shaft being disposed in the central barrel, and the two outer shafts being, respectively, disposed in the two outer barrels.

25. The media mill of claim 22, further comprising a discharge screen in fluid communication with the grinding chamber.

26. The media mill of claim 22, further comprising a water cooling jacket around the grinding chamber.

27. A chamber for use with a media mill, the chamber being specially adapted for grinding and dispersing particulate matter for fluid vehicles therein, the chamber comprising;

a first barrel portion;

a second barrel portion; and a third barrel portion, where the second barrel portion is in fluid communication with the first and third barrel portions;

wherein each barrel portion comprises a circular cross section having a cross-sectional area, and where the cross sectional area of the second barrel portion at least partially overlaps the cross sectional areas of the first and third barrel portions.

28. The chamber of claim 27, wherein each barrel portion has a central axis, the central axis positioned in a common plane.

29. The chamber of claim 28, further comprising:

a shaft disposed in each barrel portion; and a plurality of discs spaced along each shaft.

30. The chamber of claim 27, further comprising a discharge screen in fluid communication with one of the barrel portions.

* * * * *